United States Patent [19]

Chihara

[11] 3,949,545

[45] Apr. 13, 1976

[54] QUARTZ CRYSTAL TIMEPIECE

[75] Inventor: Hiroyuki Chihara, Okaya, Japan

[73] Assignee: Kabushiki Kaisha Suwa Seikosha, Tokyo, Japan

[22] Filed: Apr. 24, 1975

[21] Appl. No.: 571,125

[30] Foreign Application Priority Data

Apr. 24, 1974 Japan ..... 49-46248
July 15, 1974 Japan ..... 49-80932

[52] U.S. Cl. ..... 58/23 BA; 58/152 H; 340/249
[51] Int. Cl.[2] ..... G04C 3/00; G04B 47/06
[58] Field of Search ..... 58/23 BA, 52 R, 152 H; 340/248 B, 249

[56] References Cited

UNITED STATES PATENTS 3,641,584 2/1972 Okada ..... 58/152 H
3,672,155 6/1972 Bergey et al. ..... 58/50

*Primary Examiner*—Edith Simmons Jackmon
*Attorney, Agent, or Firm*—Blum, Moscovitz, Friedman & Kaplan

[57] ABSTRACT

A battery-powered quartz crystal timepiece is provided with a battery voltage detecting circuit utilizing the threshold voltage of a field effect transistor as a battery failure indicator. The voltage level at which failure is indicated may be selectively controlled by adjusting a load resistance value of the field effect transistor or a voltage divider intermediate the transistor and battery. The battery voltage detecting circuit may operate intermittently, the sampled output of the detecting circuit being stored in a memory circuit.

30 Claims, 12 Drawing Figures

QUARTZ CRYSTAL TIMEPIECE

BACKGROUND OF THE INVENTION

This invention relates to battery-powered quartz crystal timepieces. Most quartz crystal timepieces now being offered for sale are provided with no indication as to the status of the battery and the user is instructed to automatically change the battery after a predetermined period of use, at which time the battery capacity is presumed to be exhausted. In practice, the designated day is frequently forgotten and change of the battery of quartz crystal timepieces usually occurs after the timepiece has stopped due to the running down of the battery.

One quartz crystal timepiece of limited distribution is provided with a second battery which drives a battery status indication, an arrangement that is both expensive and bulky.

The foregoing deficiencies in the prior art battery-powered quartz crystal timepieces, and in particular, quartz crystal wristwatches, are avoided by the arrangement in accordance with the invention.

SUMMARY OF THE INVENTION

Generally speaking, in accordance with the invention, a quartz crystal timepiece is provided with a quartz crystal oscillator means for producing a time standard signal, electronic timekeeping circuit means for producing timekeeping signals in response to said time standard signal, a display means for displaying time in response to said timekeeping signals, a power source battery, and a battery-voltage detecting circuit means for producing a signal representative of the drop in voltage of said power source battery to a predetermined level, said battery-voltage detecting circuit means including a field-effect transistor and means coupling said field-effect transistor to said power source battery whereby said predetermined level is determined by the threshold voltage of said field-effect transistor. Means is provided for selectively controlling said predetermined level, said predetermined level being selected to represent the voltage of a battery a predetermined period of time before actual failure. Said means for controlling the selected voltage of said power source battery representative of impending failure may include the selection of the value of load resistance coupled to said field-effect transistor. Said means coupling said field effect transistor and power source battery may include a voltage divider for selectively setting the voltage level of said power source battery representative of impending battery failure. Said field-effect transistor may be formed on an integrated circuit chip also bearing all or a portion of said timekeeping circuitry.

Said means coupling said power source battery and battery voltage detecting circuit may include means for the intermittent sampling of the voltage of said battery and means for memorizing the sampled battery voltage. Said sampling means may include means for detecting the voltage of said power source battery at a predetermined frequency, each detection sample being for a predetermined period of time.

Sampling is preferably effected at a time other than during periods of large current draw for the purposes of driving the display means, as where said display means includes a step motor. Means may be provided for driving a hand of a watch at a frequency other than its normal frequency in response to an output signal of the battery voltage detecting circuit representative of the impending failure of the battery. The frequency of sampling may be selected to equal the frequency of advance of the hand representative of impending battery failure during the time that it is providing such an indication.

Accordingly, it is an object of this invention to provide a battery voltage detecting means for a battery-powered quartz crystal timepiece utilizing the threshold voltage of a fieldeffect transistor as the detection method.

A further object of the invention is to provide a battery failure detection circuit for a quartz crystal timepiece adapted to detect the impending failure of a battery, and including means for selecting a battery voltage at which said battery failure detecting circuit will provide an indication.

Another object of the invention is to provide a battery failure detection circuit for use with a quartz crystal timepiece adapted to periodically sample the status of the battery and store a signal representative of the status of the battery, thereby minimizing current drain by reason of said detecting circuit.

Still a further object of the invention is to provide a battery failure detection circuit for use with quartz crystal timepiece which produces a signal representative of impending battery failure, which signal causes a unique configuration of the timepiece display representative of impending battery failure.

Still other objects and advantages of the invention will in part be obvious and will in part be apparent from the specification and drawings.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
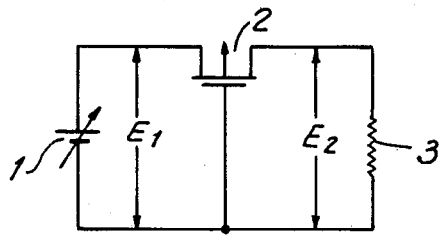
FIG. 1 is a circuit diagram of a battery voltage detecting circuit in accordance with the invention.
Figure 2:
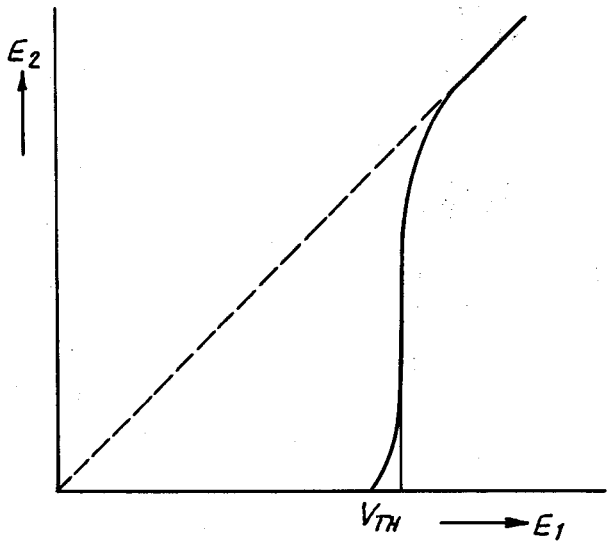
FIG. 2 is a graphical illustration of battery voltage in relation to output voltage of the circuit of FIG. 1.

Referring now to FIG. 1, the battery voltage detecting circuit depicted includes an enhancement type P-MOS field-effect transistor. Load resistor 3 is connected between the drain and gate terminals of field-effect transistor 2 while variable voltage power source 1 is connected between the source and gate terminals of said transistors. Battery 1 is representative of the power source of a quartz crystal timepiece and is shown as a variable voltage for analysis purposes only. In a conventional electronic timepiece, such as an electronic wristwatch, battery 1 would not be variable, other than by reason of usage thereof. FIG. 2 shows the relation between input voltage $E_1$ across battery 1 and output voltage $E_2$ across load resistor 3. As is clearly depicted in FIG. 2, when voltage $E_1$ is greater than the threshold voltage $V_{TH}$ of field-effect transistor 2, output voltage $E_2$ is equal to input voltage $E_1$ since field-effect transistor 2 is in a conductive state. When input voltage $E_1$ is reduced, and approaches threshold voltage $V_{TH}$, output voltage $E_2$ reduces rapidly as the field-effect transistor changes from the conductive to the non-conductive state. Finally, when input voltage $E_1$ equals or is less than the threshold voltage $V_{TH}$ or is less than that value, output voltage $E_2$ becomes zero since the field-effect transistor 2 is in the non-conductive state. The battery generally used substantially maintains its rated voltage during the bulk of its life, in other words, over the greater period of its usage, the effective voltage of the battery remains fairly stable. After a period of usage, the effective voltage of the battery diminishes relatively rapidly, as compared to the duration during which it remains fairly stable. This period of decline can occupy a period of several weeks during which the timepiece will continue to operate. Finally, a voltage level is reached at which the timepiece will not operate and the timepiece will stop in the absence of replacement of the battery. Ideally, it would be desirable to set the threshold voltage of the field-effect transistor 2 at a level such that it will provide an output signal across load 3 during the period of relatively rapid decrease in the charge of the battery but before the battery is totally discharged. Thus, it would be desirable to have field-effect transistor 2 rendered non-conductive during a period when the battery 1 has sufficient charge to sustain the operation of the timepiece but reduction in battery voltage to a level at which operation of the timepiece cannot be maintained is imminent. For example, it would be preferable if the battery failure detecting circuit produced an output signal about a week before actual battery failure, at a time when battery failure was imminent.

Figure 3:
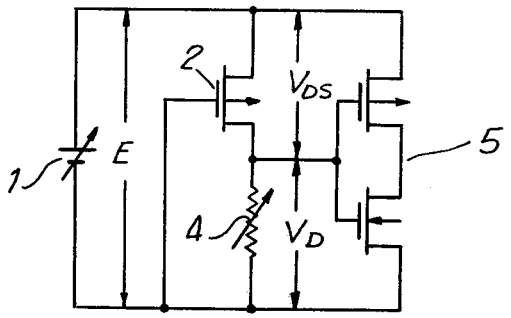
FIG. 3 is a circuit diagram of a second embodiment of the battery voltage detecting means in accordance with the invention.
Figure 4:
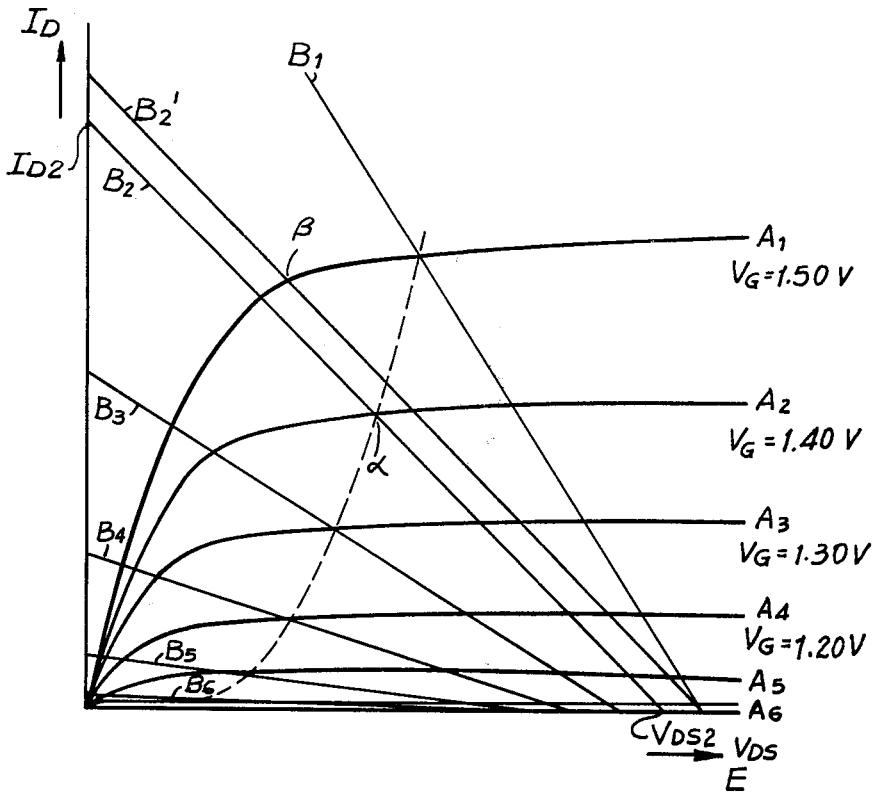
FIG. 4 is a graphical representation of the load characteristic curves of a P-MOS transistor incorporated in the circuit of FIG. 3.

However, it is difficult to strictly control and select the threshold voltage of the field-effect transistor 2 and where said field-effect transistor is formed in an integrated circuit which contains similarly integrated circuit elements forming a part of the timekeeping circuitry of the timepiece, it is difficult to change the threshold voltage of the field-effect transistor incorporated in the detecting circuit. Were it necessary to provide an independent field-effect transistor for the battery failure detection circuit and to select the transistor in accordance with its particular threshold voltage, serious restrictions on the practical application of the circuit of FIG. 1 would be presented. In order to avoid this difficulty, it is necessary to control the detecting level of the voltage drop of the battery voltage detecting means by changing the apparent threshold voltage of the field-effect transistor as more particularly described below. Referring now to FIG. 3, a battery failure detection circuit in accordance with the invention for achieving this result is depicted in which like reference numerals as were used in connection with FIG. 1 are applied to the circuit elements thereof. Again, the battery 1 is connected across the source and drain terminals of a field-effect transistor 2 of the P-MOS type. A variable resistor 4 is connected between the drain and gate terminals of said transistor. An inverter 5 formed from a pair of complementary coupled MOS transistors is connected with the source-drain path thereof across battery 1 and the commonly-connected gate input thereof connected intermediate the source of transistor 2 and variable resistor 4. An example of a family of load characteristic curves for a P-MOS transistor 2 of FIG. 3 is depicted in FIG. 4, said curves demonstrating the change in detecting sensitivity caused by changes in load resistance. The axis of abscissae of FIG. 4 represents the voltage $V_{DS}$ between the drain and source of transistor 2 of FIG. 3 and the power source voltage E. The axis of ordinates of FIG. 4 represents the drain current $I_D$. Curves $A_1$ through $A_6$ represent the $V_{DS}$ vs. $I_D$ characteristic curve at six respective gate voltages, $V_G$. The gate voltage ranges from 1.0 to 1.5 volts in 0.1 voltage increments. Lines $B_1$ through $B_6$ represent load lines obtained by assuming that drain voltage $V_D$ is equal to 0.7 volts at respective supply voltage increments between 1.0 and 1.5 volts. The 0.7 volt value for drain voltage $V_D$ is assumed on the basis that 0.7 volts is the threshold voltage of inverter 5. Curve $A_1$ and line $B_1$ correspond as do the remaining similarly numbered curves and lines. On example of the application of FIG. 4 is that where it is desired to establish the drain voltage $V_D$ at 0.7 volts and to switch inverter 5 when the supply voltage falls to 1.4 volts, the load resistance is obtained from a straight line connecting the point 1.5 volts on the axis of abscissae and the point $\alpha$ at which $V_{DS}$ is 0.7 volts on the $I_D$ vs. $V_{DS}$ characteristic curve $A_2$ representative of a $V_G = 1.4$ volts, namely on load line $B_2$. Since the gate voltage $V_G$ equals to the supply voltage E, it must be kept in mind that the former changes with the latter. The load resistance $R_{L2} = V_{DS2}/I_{D2}$ and the drain voltage when the supply voltage is 1.5 volts may be obtained from the intersection $\beta$ of the straight line $B'_2$, which is parallel with line $B_2$ and passes through the 1.5 volts point on the axis of abscissae, and an $I_D$ vs. $V_{DS}$ characteristic curve corresponding to a $V_G = 1.5$ volts, namely curve $A_1$. The drain voltage $V_D$ is the value which is obtained by deducting the source-drain voltage from 1.5 volts, and is euqal to 1.01 volts, as taken from the drawing.

Thus, where $R_{L2}$ is the load resistance and the supply voltage is 1.5 volts, the drain voltage $V_D$ is 1.01 volts and inverter 5 is in a low state. When the supply voltage falls to 1.4 volt, the drain voltage $V_D$ becomes 0.7 volts and the inverter 5 is high. Accordingly, it is possible to set the detecting level of the battery voltage drop to 1.4 volts by selection of the resistance of load resistor 4.

In further examples, where the load resistance $R_{L3}$ obtained from load line $B_3$ is considered, the drain voltage $V_D$ is 1.25 volts when the supply voltage E is 1.50 volts and $V_D$ is 0.7 volts when E is 1.30 volts. Where load resistance $R_{L4}$ is considered, $V_D$ is 1.38 volts and E is 1.50 volts and $V_D$ is 0.7 volts when E is 1.20 volts. Where the load resistance $R_{L5}$ is considered, $V_D$ is 1.46 volts when E is 1.50 volts and $V_D$ is 0.7 volts when E is 1.10 volts. When load resistance $R_{L6}$ is considered, $V_D$ is 1.49 volts when E is 1.50 volts and $V_D$ is 0.7 volts when E is 1.00 volts.

Figure 5:
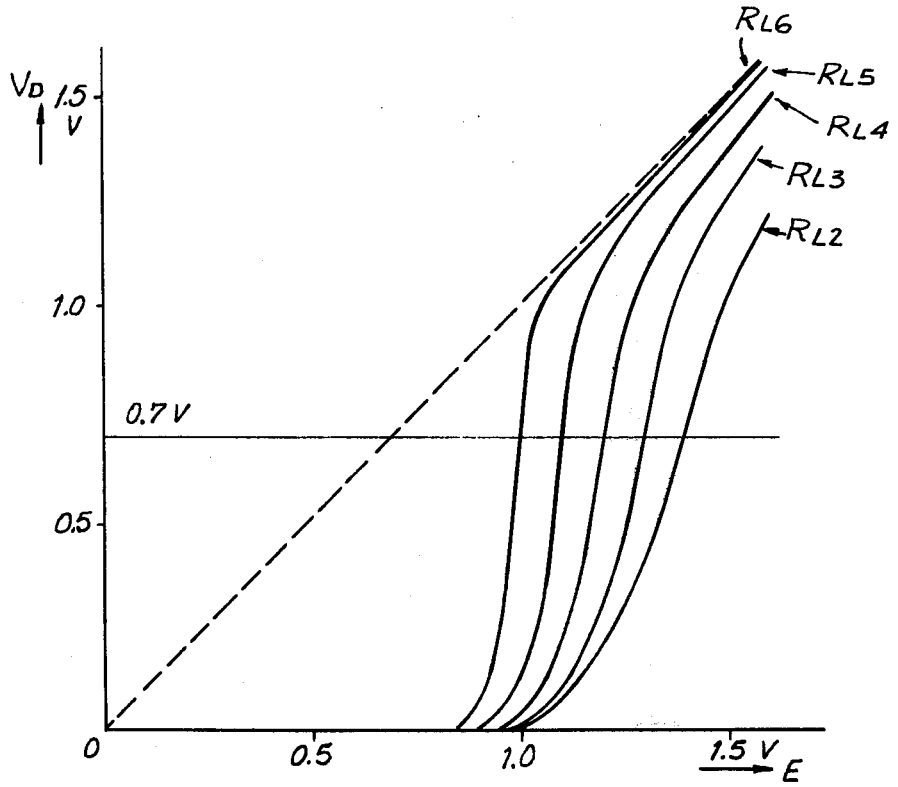
FIG. 5 is a graphical representation of the characteristic curves of supply voltage E and drain voltage $V_D$ for a number of load resistances.

By the selection of the value of load resistor 4 of FIG. 3, a single field-effect transisior 2 can be utilized to selectively detect a plurality of different selected voltage levels of battery 1. FIG. 5 shows the characteristic curve of the supply voltage E and the drain voltage $V_D$ at the various above-described load resistances $R_{L2}$ through $R_{L6}$. From a consideration of FIG. 5, it is apparent that the supply voltage corresponding to a drain voltage of 0.7 volts depends on the value of load resistance 4 coupled to field-effect transistor 2.

Figure 6:
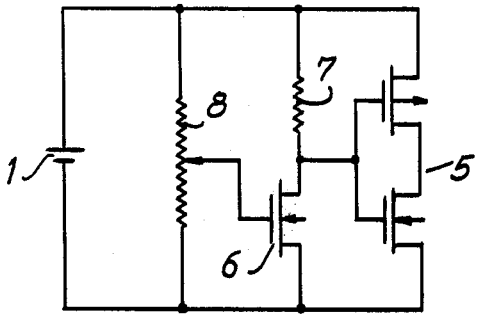
FIG. 6, 7 and 8 are third, fourth and fifth embodiments, respectively, of battery voltage detecting means in accordance with the invention.

Another embodiment for selecting the voltage drop in response to which a field effect transistor will produce a voltage failure signal is illustrated in FIG. 6, like reference numbers as were used in FIG. 3 being used for like elements in FIG. 6. In ths embodiment, in place of a variable load resistor, the battery is connected across the fixed terminals of a voltage divider resistor 8, the gate of an N-MOS transistor of the enhancement type being connected to the variable arm of said voltage divider. A load resistor 7 is connected in series with the source-drain path of transistor 6 and the gate input of inverter circuit 5 is connected intermediate the load resistor and transistor 6. In effect, the voltage of the battery is adjusted to the threshold voltage of transistor 6 by means of voltage divider 8 so that the output of inverter 5 produces a signal representative of imminent battery failure at a selected voltage level of battery 1.

Figure 7:
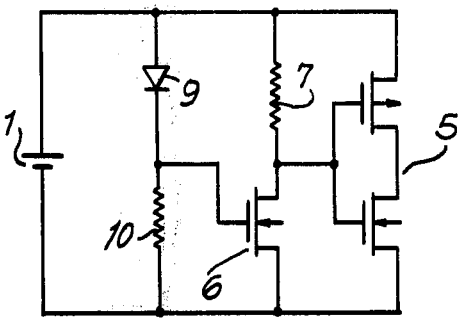

Still a further embodiment similar in structure to FIG. 6 as depicted in FIG. 7, like reference numerals being used in both figures. The battery failure detection circuit of FIG. 7 is provided with a voltage divider defined by diode 9 and resistor 10, the gate of transistor 16 being connected therebetween. In other respects the battery failure detection circuit of FIG. 7 corresponds in structure to the circuit of FIG. 6.

The circuits of FIGS. 3, 6 and 7 permit the changing of the apparent threshold voltage of the field-effect transistor of the battery failure detection circuit in accordance with the invention, thereby permitting the formation of the field-effect transistor as part of an integrated circuit chip carrying the timekeeping circuitry of an electric timepiece, said field-effect transistor being constructed in the same manner as the MOS transistors defining said timekeeping circuitry.

The imminent failure of the battery can be readily displayed in response to the output of the battery failure display circuit in accordance with the invention. Thus, the output signal can be used to cause one or more liquid crystal display elements of a digital display to blink, thereby providing a visual indication of battery failure. Such blinking of a liquid crystal display may be caused, by way of example, by the gating of a low frequency signal from the timekeeping circuitry to the display driving circuitry in response to an output of the battery failure detection circuit representative of impending battery failure. As noted above, the voltage level at which the field-effect transistor will cause the production of a battery failure signal is selected to provide sufficient time for the user of the watch to effect a replacement of the battery, without materially reducing the useful life of the battery.

The variable load resistor 4 of FIG. 3 is shown by way of example, and the arrangement in accordance with the invention is not limited to the use of such a variable resistor. For Example, the automatic trimming of a thick film resistance on a solid-state substrate or a selectively chosen solid resistive element may be utilized.

Figure 8:
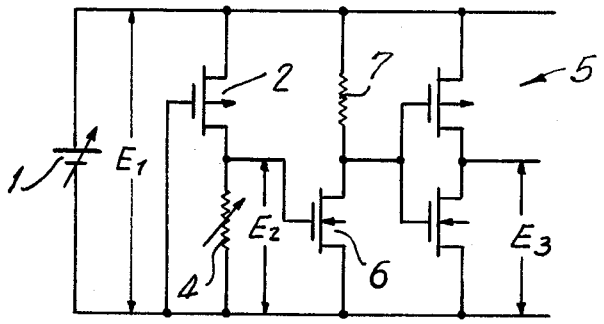
Figure 9:
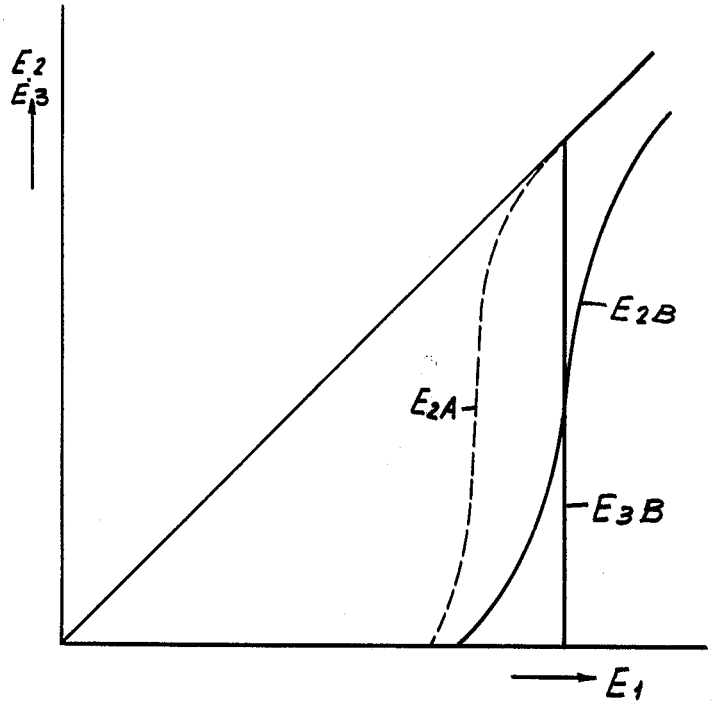
FIG. 9 is a graphical representation of the relationship between supply voltage and output voltages of the battery-voltage detecting circuit of FIG. 8.

Still a further battery failure detection circuit in accordance with the invention is depicted in FIG. 8, like reference numerals being applied to corresponding elements in FIGS. 3 and 6. In this embodiment, a P-MOS enhancement-type transistor 2 is connected with its source-drain path in series with a load resistor 4, said series connection being coupled across battery 1. A N-MOS enhancement-type field-effect transistor 6 is connected with its source-drain path connected in series with a resistor 7, said series connection being likewise connected across battery 1, the gate of transistor 6 being connected intermediate transistor 2 and load resistor 4. The input of an inverter 5 formed from complementary coupled P-MOS and N-MOS transistors is connected intermediate transistor 6 and resistor 7, the output thereof being taken at the junction between the respective source-drain paths of the transistors of inverter 5 as represented by voltage $E_3$. The relation between supply voltage $E_1$ (of battery 1) and output voltage $E_2$ (across load resistor 4) and $E_3$ (at inverter 5) is shown in FIG. 4. Curve $E_{2A}$ depicted in FIG. 4 represents the output voltage $E_2$ when the value of variable resistor 4 is relatively large. Curves $E_{2B}$ and $E_{3B}$ represent the output voltages when the resistance of variable resistance 4 is relatively small. Thus, the switching voltage (the level to which battery 1 must fall to produce an output signal in the circuit of FIG. 8) can be easily controlled by selection of the resistance value of load resistor 4.

One practical difficulty with the foregoing battery failure detection circuits is the increase in current consumption by said circuit when the load resistance is made small. Said load resistance can be several tens of kilo-ohms, depending on the threshold voltage of the field-effect transistor of the circuit and maximum drain current. In such a case, current consumption greatly exceeds ten micro-ampre, a current consumption which would render the circuit impractical. In order to avoid this difficulty, the status of the battery voltage is not detected on a continuous basis, but rather, detection is effected periodically for predetermined time periods, thereby greatly reducing current consumption of the battery voltage detecting circuit.

Generally, in a quartz crystal wristwatch, the standard battery voltage is 1.59 volts and the average current consumption is 10 micro-ampere. In such case, there is a period of time of about 1 week during battery failure that the battery voltage falls from 1.45 volts to 1.35 volts. The minimum charge for actuating the quartz crystal wristwatch is about 1.35 volts. Accordingly, if the detecting level of the battery failure detecting circuit is selected to be between 1.45 and 1.50 volts, the quartz crystal wristwatch will be actuated for about one week after an indication of the battery's impending failure is displayed. The relatively slow rate at which the battery voltage falls also renders it unnecessary to monitor battery voltage continuously. The battery failure detection circuit may be actuated as infrequently as once a day and still be effective, the resulting output signal being memorized in suitable circuitry. The means for displaying an indication of impending battery failure can be driven from the memory means. Even if the battery voltage is detected once a second for a detecting period of one millisecond, the average current consumption of the detecting circuit is one thousandth of the current consumption where battery voltage is continuously detected, namely 0.1 micro-ampere, a level which is less than that which can be ignored when compared against the total current consumption.

Figure 10A:
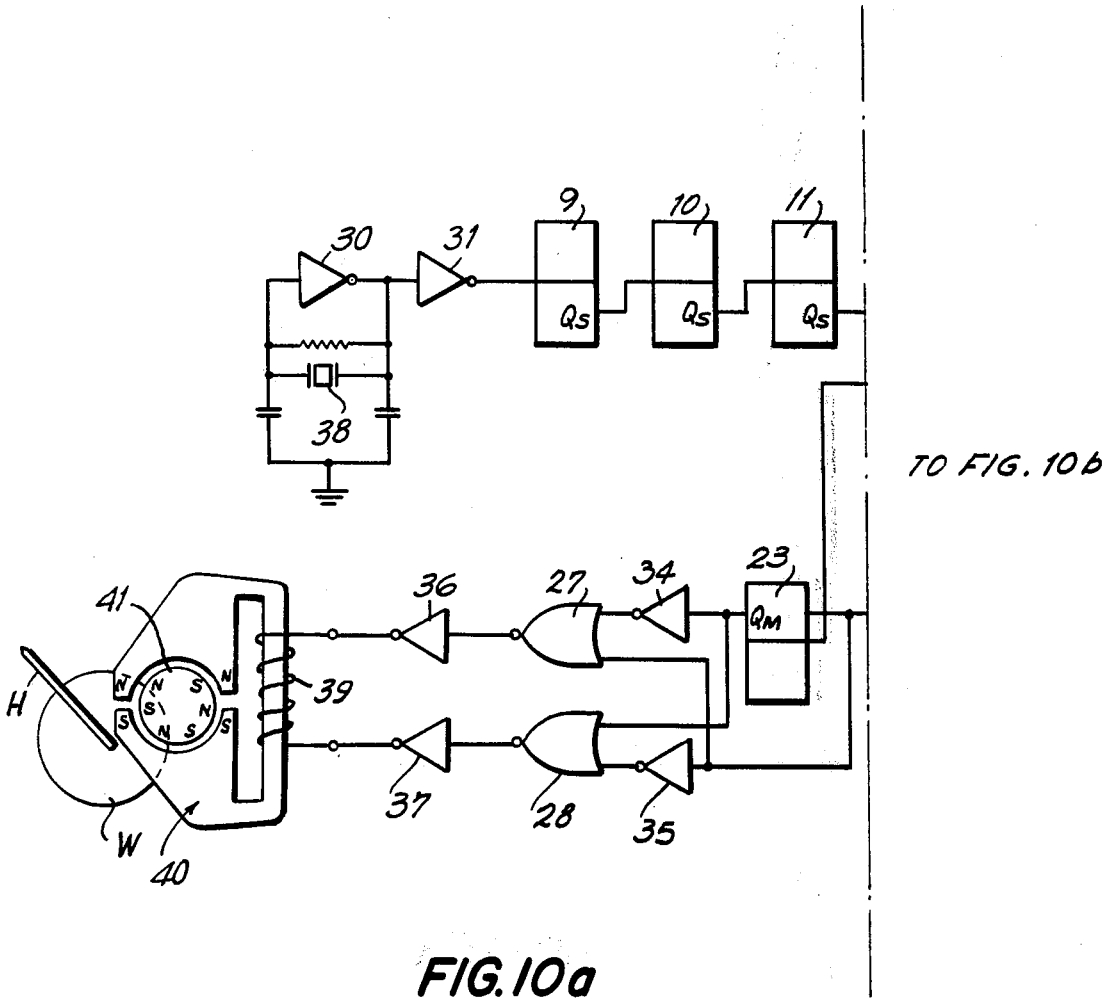
FIGS. 10*a* and 10*b* are a circuit diagram of a quartz crystal timepiece in accordance with the invention.
Figure 10B:
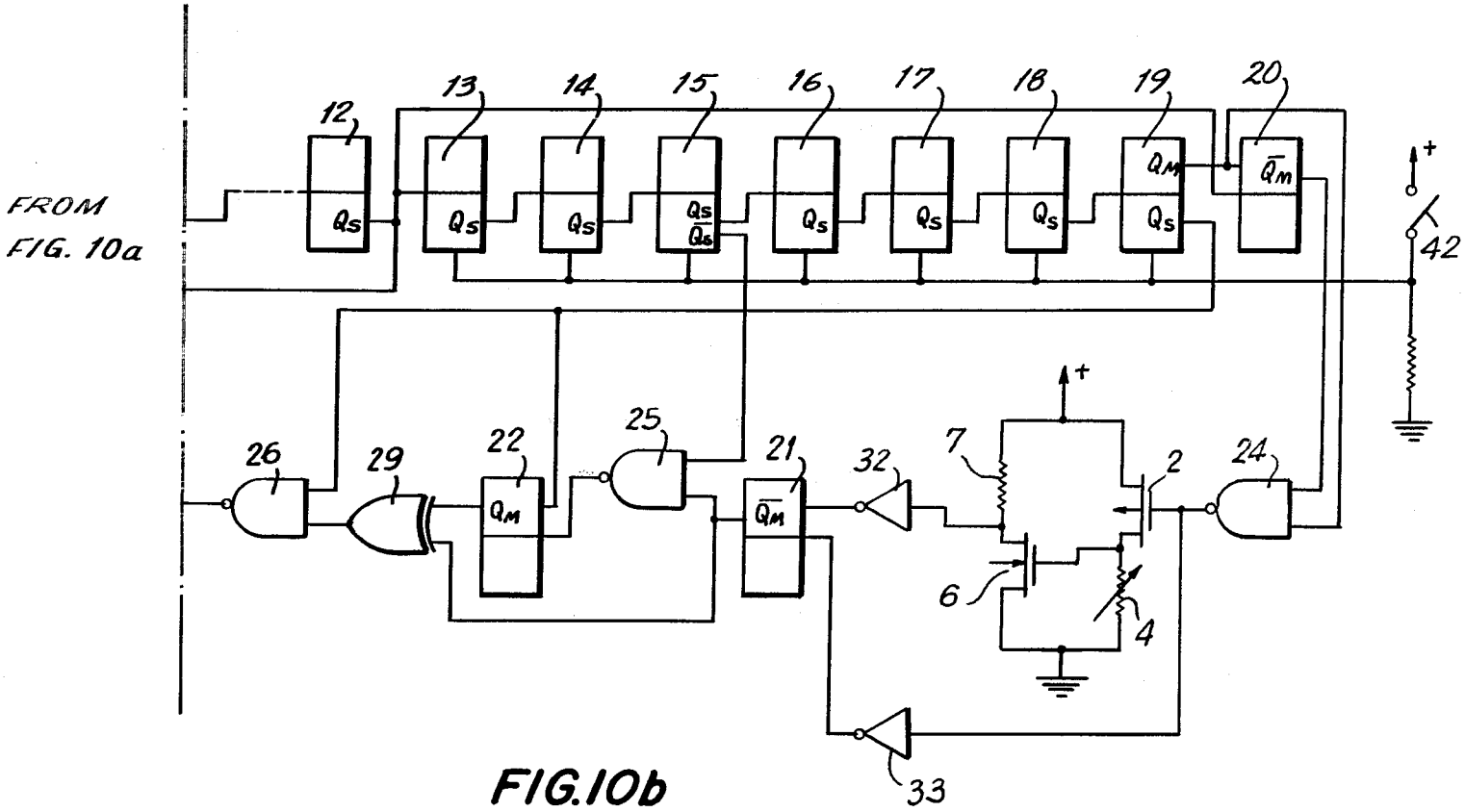

Referring now to FIGS. 10*a* and 10*b*, a quartz crystal timepiece embodying the invention is depicted by way of example. The circuit includes negative trigger master-slave flip-flop circuits 9 through 23 (hereinafter referred to as "FF"). The D terminals of each of said flip-flop circuits is connected to the $Q_s$ terminal thereof unless otherwise designated in the drawing. FF 9–19 constitute a divider circuit for dividing the high frequency timekeeping signal produced by the oscillator circuit including quartz crystal oscillator 38 and inverters 30 and 31. FF 20 and NAND gate 24 constitute a control circuit for a battery voltage detecting circuit in accordance with the invention, said control circuit controlling the frequency of sampling and the duration of each sample. P-MOS transistor 2, variable load resistor 4, N-MOS transistor 6, load transistor 7 and inverter 32 (corresponding to inverter 5 of FIG. 8) represent the battery voltage detecting circuit in accordance with the invention. FF 21 represents a memory circuit for memorizing the output signal of the battery failure detecting circuit in accordance with the invention, FF 21 being gated through inverter 33 from the output of NAND gate 24. FF 22, NAND gates 25 and 26 and EXCLUSIVE OR gate 29 constitute a control circuit for controlling the selective display of a visual indication representative of impending battery failure. FF 23, inverters 34 and 35 and NOR gates 27 and 28 represent a wave shaping circuit for forming driving signals. Inverters 36 and 37 constitute a driving circuit which supplies a motor driving coil 39 with relatively large current. Said motor driving coil forms a part of a step motor, being wound around a magnetic core 40 having a pole structure positioned for cooperation with a permanent magnet rotor 41. Said permanent magnet rotor 41 is mechanically coupled to drive a gear train represented schematically by wheel W which drives the hands of a watch, the second hand H being shown schematically in FIG. 10*a*. Switch 42 is a reset switch for resetting the divider stages FF 13–19 to zero.

Figure 11:
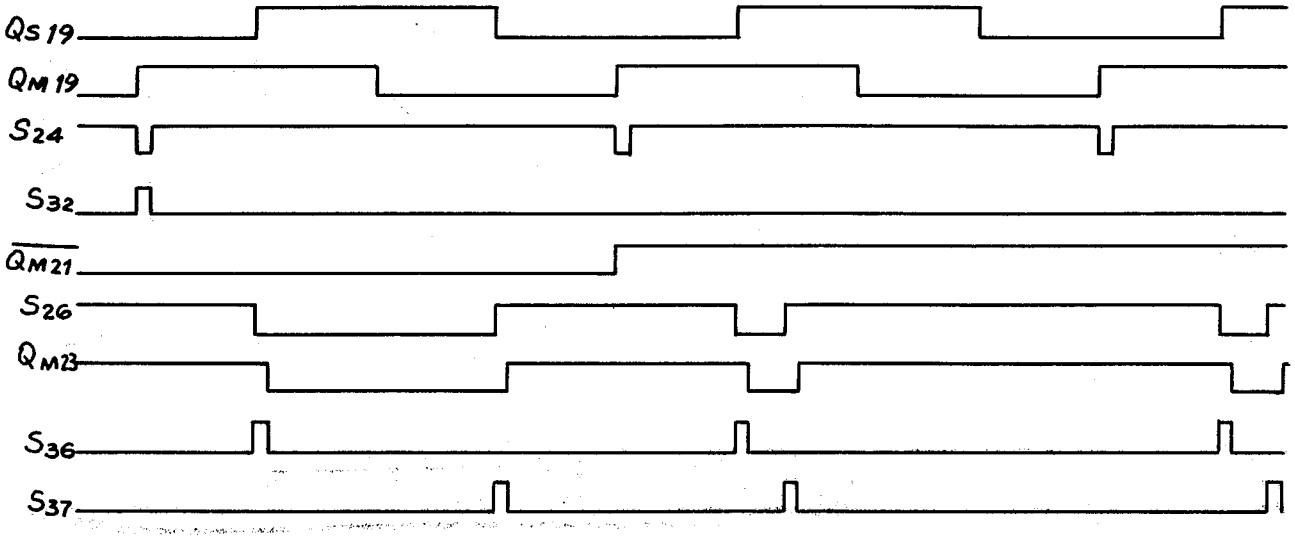
FIG. 11 is a timing chart of the signals of selected elements of the circuit of FIG. 10.

The operation of the circuit of FIGS. 10*a* and 10*b* in accordance with the invention may be appreciated by a consideration of the timing chart of FIG. 11 and the following discussion. NAND gate 24 has applied to it the $Q_M$ output of FF 19 and the $Q_M$ output of FF 20 to produce a pulsed output having a period of two seconds, each pulse having a duration of 7.8 ms. P-MOS transistor 2 is conductive only when the battery voltage is higher than the predetermined level as determined by variable resistor 4, and then only during the pulse output of NAND gate 24. In other words, the P-MOS transistor 2 is conductive only for 7.8 ms of each cycle, at best, and the output of inverter 32 is high only for that time. When the battery voltage is lower than the predetermined level, the P-MOS transistor 2 cannot be conductive even if the gate voltage is low, and accordingly, the output of the inverter 32 remains low. In the timing chart of FIG. 11, it is assumed that the battery voltage reaches the predetermined level intermediate the first two pulses of signal $S_{24}$ representative of the output of NAND gate 24.

Since the sampling detection by the battery failure detection circuit is made at a frequency of 2 seconds and for a detecting timewidth of 7.8 ms, P-MOS transistor 2 and N-MOS transistor 5 are almost always in a non-conductive condition, so that the current consumption of the battery failure detection circuit is minimal. Memory FF 21 writes the detected signal from the output of inverter 32 only during the period that the battery voltage is being detected, as determined by the output of inverter 33. The contents of memory circuit 21, namely at terminal $Q_M$ thereof, represented by the signal $Q_{M21}$ of FIG. 11 is applied to the wave shaping circuit which produces at NAND gate 26, the signal $S_{26}$ depicted in FIG. 11. The effect of this signal is to cause the second hand to be advanced at a normal rate of once per second when the battery voltage is higher than the predetermined level, namely when $Q_{M21}$ is in a low condition, and to be advanced by two pitches once every 2 seconds when the battery voltage falls below a predetermined level (representative of impending battery failure), at which time $Q_{M21}$ is in a high condition. The driving pulse as applied to the pulse motor from inverters 36 and 37 are respectively depicted in FIG. 11 by signals $S_{36}$ and $S_{37}$. The first pulses of each said signal being representative of a normal 1 second interval advance of the second hand, the second and third pulses being representative of two second incremental advances of the second hand every two seconds, which abnormal advance of the second hand provides the visual indication of impending battery failure. A comparison of signal $S_{24}$ from NAND gate 24 and signals $s_{36}$ and $S_{37}$ reveals that battery voltage sampling occurs at a point of time in the cycle other than when the driving pulses are applied to the motor, thereby further minimizing current drain on the battery. It should be noted that the timing between the time of detection of the battery voltage (time of sampling) and the time of application of the driving current can be readily selected for efficient operation of the battery, taking into consideration the operating characteristics of the battery such as maximum peak current. The above-described sample technique can be applied to a liquid crystal display electronic timepiece wherein the display is blinked in response to a battery failure signal.

It will thus be seen that the objects set forth above, and those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

WHAT IS CLAIMED IS:

1. An electronic timepiece comprising driving circuit means for producing timekeeping signals; display means operatively coupled to said timekeeping circuit means for the visual display of time in response to said timekeeping signal; a battery power source operatively coupled to said driving circuit means for powering same; and battery failure detecting circuit means coupled to said battery for producing a signal representative of impending battery failure when the voltage of said battery falls below a predetermined level, said battery-voltage detecting circuit means including a field-effect transistor and means coupling said fieldeffect transistor to said battery whereby said predetermined voltage level is detected by the threshold voltage of said field-effect transistor.

2. An electronic timepiece as recited in claim 1, wherein said battery failure detecting circuit means includes means for selectively determining said predetermined voltage level at which said battery failure detecting means produces said battery failure signal without affecting the threshold voltage of said field-effect transistor.

3. An electronic timepiece as recited in claim 2, wherein said battery failure voltage level determining means includes a resistor coupled as a load to said field-effect transistor, said load resistor being of a value selected to produce a battery failure signal at the desired voltage level of said battery.

4. An electronic timepiece as recited in claim 3, wherein said load resistor is a variable resistor.

5. An electronic timepiece as recited in claim 3, wherein said field-effect transistor includes a source, drain and gate, said load resistor being connected in series with the source-drain path of said transistor, said series connection being connected across said battery, said gate being connected intermediate said battery and load resistor.

6. An electronic timepiece as recited in claim 5, including a complementary coupled inverter circuit means having an input and an output, said battery failure signal appearing at said inverter output, said inverter input being connected intermediate said transistor and load resistor.

7. An electronic circuit as recited in claim 3, wherein said field-effect transistor is a P-MOS enhancement type transistor.

8. An electronic circuit as recited in claim 2, wherein said battery failure voltage level determining means includes voltage divider means having an input coupled across said battery and an output, said field-effect transistor including a gate coupled to the output of said voltage divider means, whereby a selected fraction of said battery voltage is applied to said field-effect transistor, said fraction being selected to render the output voltage of said voltage divider means equal to the threshold voltage of said transistor when the battery voltage reaches said predetermined level.

9. An electronic timepiece as recited in claim 8, wherein said voltage divider means includes a resistive voltage divider having a pair of fixed terminals defining said input anc connected across said battery and a variable terminal connected to said gate of said transistor.

10. An electronic timepiece as recited in claim 8, wherein said field-effect transistor includes a source and drain, and further including a load resistor connected in series with the source-drain path of said transistor, said series connection being connected across said battery, and inverter means having an input and output, said inverter means input being connected intermediate said load resistor and transistor and said battery failure signal appearing at said inverter means output.

11. An electronic circuit as recited in claim 10, wherein said field-effect transistor is a N-MOS enhancement type transistor.

12. An electronic timepiece as recited in claim 8, wherein said voltage divider means includes a diode and a resistor connected in series with said diode, said series connection being connected across said battery, said transistor gate being connected intermediate said diode and resistor of said voltage divider means.

13. An electronic timepiece as recited in claim 3, wherein said battery voltage detecting circuit means includes a further field-effect transistor having a drain, source and gate, and a further load resistor connected in series with the source-drain path of said further transistor, said series connection being connected across said battery, said further transistor gate being connected intermediate said first-mentioned transistor and first-mentioned load resistor.

14. An electronic timepiece as recited in claim 13, including inverter means having an input and an output, said inverter means input being connected to the junction between said further transistor and further load resistor, said inverter means output having said battery failure signal thereat.

15. An electronic timepiece as recited in claim 14, wherein said first-mentioned field-effect transistor is a P-MOS enhancement type transistor and said further field-effect transistor is an N-MOS enhancement type transistor.

16. An electronic timepiece as recited in claim 1, wherein said predetermined voltage of said battery at which said battery failure signal is produced is selected to provide a predetermined period of time between when said battery reaches said predetermined voltage and when said battery falls to a level at which it is unable to drive said timekeeping circuit means.

17. An electronic timepiece as recited in claim 1, wherein said timekeeping circuit means includes a quartz crystal oscillator for producing a high frequency timekeeping signal and frequency division circuit means for producing said timing signals in response to said timekeeping signal.

18. An electronic timepiece as recited in claim 1, wherein said timekeeping circuit means includes MOS transistors, said field-effect transistor being a MOS transistor formed of the same construction as at least a portion of the MOS transistors of the timekeeping circuit means and integrated therewith on a single integrated circuit chip.

19. An electronic timepiece as recited in claim 1, wherein the means coupling said battery failure detecting circuit means and said battery includes means for periodically coupling said battery failure detecting circuit means and said battery, and further including memory circuit means for storing the battery failure signal, whereby the battery status is continuously available but the battery failure detecting circuit operates in a sampling mode.

20. An electronic timepiece as recited in claim 19, wherein said battery voltage detecting circuit means samples the voltage of the battery at a predetermined sampling period, each sampling being of a predetermined time duration.

21. An electronic timepiece as recited in claim 20, wherein said timekeeping signals include pulse driving signals of a predetermined frequency, said sampling frequency of said battery failure detecting circuit means being selected to be out of phase with said driving signals.

22. An electronic timepiece as recited in claim 19, wherein said display means includes hand means and step motor means operatively coupled to said hand means for driving same, said timekeeping signals being coupled to said step motor means to effect operation thereof, and including means coupling said step motor and said memory means for driving said hand in other than its normal mode in response to a battery failure signal representative of impending battery failure.

23. An electronic timepiece as recited in claim 22, wherein said hand is a second hand normally indexed at predetermined increments, said means coupling said memory circuit means and said step motor means being adapted to apply driving signals to said step motor means to cause said second hand to increment at greater than normal intervals.

24. An electronic timepiece as recited in claim 23, wherein the interval of advance of said second hand when said battery failure signal is representative of impending battery failure is representative of a frequency equal to the sampling frequency of said battery failure detecting circuit means.

25. An electronic timepiece comprising timekeeping circuit means for producing timekeeping signals representative of actual time; display means operatively coupled to said timekeeping means for the visual display of time in response to said timekeeping signals; a battery power source; battery failure detecting circuit means having an input and an output for producing a battery failure signal representative of impending failure of said battery when the voltage level applied to its input representative of the voltage of said battery reaches a predetermined level; means for periodically applying a signal representative of said battery voltage to said battery failure detection circuit means input; and memory means coupled to said battery failure detection circuit means output for storing the battery failure signal.

26. An electronic timepiece as recited in claim 25, including means operatively coupling said memory means and said display means whereby said display means is disposed in a mode representative of impending battery failure in response to a battery failure signal in said memory means representative of such impending battery failure.

27. An electronic timepiece as recited in claim 25, wherein said timekeeping circuit means includes a quartz crystal oscillator means for producing a high frequency time standard signal and frequency divider circuit means for producing said timekeeping signals in response to said high frequency timekeeping signals, said sampling means for periodically applying a voltage representative of the voltage of the battery to said battery failure detecting circuit means being coupled to said frequency divider circuit means for actuation in response to said timekeeping signals, whereby said battery is sampled at a predetermined frequency, each sample being of a predetermined duration.

28. An electronic timepiece as recited in claim 27, wherein said display means is adapted to be responsive to pulsed driving signals of a timekeeping frequency, said sampling means being adapted to sample the voltage of said battery out of phase with said pulsed driving signals, whereby battery drain is minimized.

29. An electronic timepiece as recited in claim 26, wherein said display means includes a hand means for displaying time and step motor means operatively coupled to said hand means for driving same, said step motor means being driven in response to said timekeeping signals; said means coupling said memory means and display means being adapted to modify the driving signals applied to said step motor means in response to a battery failure signal representative of the impending battery failure so that said hand is advanced in other than a normal mode.

30. An electronic timepiece as recited in claim 29, wherein said hand is a second hand normally advanced at predetermined increments, said means coupling said memory means and said display means being adapted to apply driving signals to said step motor means and said sampling means being adapted so that the frequency of sampling is equal to the frequency represented by the incremental advancement of said second hand in response to a battery failure signal representative of impending battery failure.

* * * * *